US009963966B2

(12) United States Patent
Mather et al.

(10) Patent No.: US 9,963,966 B2
(45) Date of Patent: May 8, 2018

(54) ADVANCING RAM PIN RETENTION DEVICE

(71) Applicant: Joy MM Delaware, Inc, Wilmington, DE (US)

(72) Inventors: Richard Mather, Wigan (GB); Paul Rimmer, Wigan (GB); Mark Brocklehurst, Warrington (GB)

(73) Assignee: Joy MM Delaware, Inc., Wilimington, DE (US)

( * ) Notice: Subject to any disclaimer, the term of this patent is extended or adjusted under 35 U.S.C. 154(b) by 0 days. days.

(21) Appl. No.: 15/429,548

(22) Filed: Feb. 10, 2017

(65) Prior Publication Data

US 2017/0152746 A1 Jun. 1, 2017

Related U.S. Application Data

(62) Division of application No. 14/619,523, filed on Feb. 11, 2015, now Pat. No. 9,605,539.

(51) Int. Cl.
*E21D 23/04* (2006.01)
*E21D 23/00* (2006.01)

(52) U.S. Cl.
CPC ..... *E21D 23/049* (2013.01); *E21D 23/0052* (2013.01)

(58) Field of Classification Search
CPC ... E21D 23/04; E21D 23/0436; E21D 23/049; E21D 23/0052; E21D 23/081;
(Continued)

(56) References Cited

U.S. PATENT DOCUMENTS 1,049,438 A * 1/1913 Augustine ..... F16C 11/06 285/274
1,460,877 A 7/1923 York
(Continued)

FOREIGN PATENT DOCUMENTS

DE 3003857 A1 * 8/1981 ..... E21C 35/14
DE 3211443 A1 * 9/1983 ..... E21D 23/04
(Continued)

OTHER PUBLICATIONS

Polish Search Report for Application No. 416079 dated Jul. 14, 2016 (1 page).
GB1602186.7 Search Report dated Sep. 6, 2016 (1 page).

*Primary Examiner* — Jonathan P Masinick
(74) *Attorney, Agent, or Firm* — Michael Best & Friedrich LLP

(57) ABSTRACT

A pin retaining assembly for an advancing ram includes a retention plate and a retainer. The retention plate includes two oppositely facing surfaces and a channel with a notch between the two surfaces. The retainer includes a main body, a pin receiving slot, and at least two flanges. The main body is configured to slide into the notch of the channel and extend through a surface of the retention plate. The pin receiving slot has an open mouth through an end of the main body. A first flange extends from one end of the main body along a surface of retention plate and a second flange extends from another end of the main body along another surface of retention plate. The flanges retain the main body of the retainer in the first notch from moving in a direction defined by a longitudinal axis of the pin receiving slot.

9 Claims, 4 Drawing Sheets

(58) Field of Classification Search
CPC ..... E21D 23/0004; E21D 23/0034; E21D 23/0043; E21D 23/006; E21D 23/063; Y10T 403/32893; Y10T 403/32918; Y10T 403/32861
See application file for complete search history.

(56) References Cited

U.S. PATENT DOCUMENTS

| | | | | | |
|---|---|---|---|---|---|
| 1,651,241 | A | | 11/1927 | Anderson | |
| 2,154,679 | A | | 4/1939 | Hill | |
| 2,730,413 | A | | 1/1956 | Smith | |
| 2,769,673 | A | | 11/1956 | Valverde, Sr. | |
| 3,844,663 | A | * | 10/1974 | Prette | F16C 11/045 267/154 |
| 4,034,946 | A | * | 7/1977 | Zimmer, Jr. | F21V 21/30 248/183.2 |
| 4,242,014 | A | | 12/1980 | Plevak et al. | |
| 4,313,698 | A | | 2/1982 | Maykemper et al. | |
| 4,379,661 | A | | 4/1983 | Wojaczek et al. | |
| 4,568,222 | A | | 2/1986 | Hill | |
| 4,600,340 | A | | 7/1986 | Rosenberg | |
| 4,749,311 | A | | 6/1988 | Watermann et al. | |
| 4,828,433 | A | | 5/1989 | Wojaczek et al. | |
| 4,934,758 | A | | 6/1990 | Walters | |
| 4,940,363 | A | | 7/1990 | Brown et al. | |
| 5,026,197 | A | | 6/1991 | Johnson et al. | |
| 5,242,238 | A | * | 9/1993 | Warner | B60G 13/001 248/289.11 |
| 5,252,006 | A | | 10/1993 | Plevak | |
| 5,697,254 | A | | 12/1997 | Kubosaki | |
| 5,791,809 | A | * | 8/1998 | Bessey | E02F 3/58 403/157 |
| 5,807,007 | A | | 9/1998 | Stemper | |
| 6,829,883 | B2 | | 12/2004 | Sathianathan et al. | |
| 7,341,545 | B2 | * | 3/2008 | Cao | A63B 21/15 403/150 |
| 8,376,648 | B2 | * | 2/2013 | Marshall | F16C 11/045 403/161 |
| 9,458,716 | B2 | * | 10/2016 | Horn | E21D 23/006 |
| 9,605,539 | B2 | * | 3/2017 | Mather | E21D 23/049 |
| 2011/0058894 | A1 | * | 3/2011 | Heaphy | E02F 9/2833 403/157 |

FOREIGN PATENT DOCUMENTS

| | | | | | |
|---|---|---|---|---|---|
| DE | 3211443 | A1 | | 9/1983 | |
| DE | 3713887 | A1 | | 11/1988 | |
| DE | 3837600 | A1 | * | 5/1990 | E21D 23/04 |
| DE | 4406166 | A1 | * | 8/1995 | E21D 23/0095 |
| PL | 216327 | A1 | | 1/1980 | |
| PL | 159223 | B1 | | 11/1992 | |
| PL | 66797 | Y1 | | 10/2013 | |
| WO | WO-2006130918 | A1 | * | 12/2006 | E21D 19/02 |

* cited by examiner

ADVANCING RAM PIN RETENTION DEVICE

CROSS-REFERENCE TO RELATED APPLICATIONS

This application claims priority to co-pending U.S. patent application Ser. No. 14/619,523, filed on Feb. 11, 2015, the entire contents of which are incorporated herein by reference.

FIELD

The disclosure relates to a mechanism and method used to attach an advancing ram to a powered roof support base of a longwall mining system.

BACKGROUND

Self-advancing longwall mining systems are used to mine coal and other materials by using a heavy duty shearer assembly that shears away layers of a seam in an underground mine, and an armored face conveyor that removes the coal from the mining site. A row of powered roof supports hold the mine roof as the shearer assembly and armored face conveyor operate below. The self-advancing longwall mining system also includes an advancing ram that advances the shearer assembly, armored face conveyor and powered roof supports into the seam as progress is made.

The discussion above is merely provided for general background information and is not intended to be used as an aid in determining the scope of the claimed subject matter.

SUMMARY

According to one aspect of the invention, the invention provides a pin retaining assembly for an advancing ram, the pin retaining assembly comprising: a retention plate including a first surface, a channel, and a first notch opening into the channel; and a first retainer including: a first main body received in the first notch and extending through the first surface of the retention plate; a pin receiving slot in the first main body, the pin receiving slot having an open mouth; a first flange extending from the main body along the first surface of the retention plate such that the first retainer is loosely supported by the retention plate.

In another aspect of the invention, the retention plate includes a second notch that faces the first notch across the channel, the pin retaining assembly further comprising: a second retainer that includes: a second main body received in the second notch and extending through the first surface of the retention plate; a pin receiving slot in the second main body, the pin receiving slot having an open mouth; a first flange extending from second main body along the first surface of the retention plate such that the second retainer is loosely supported by the retention plate.

In another aspect of the invention, the retention plate includes a second surface facing in a direction opposite the first surface; the first main body extends through the second surface of the retention plate; and the first retainer includes a second flange extending from the first main body along the second surface of the retention plate. In another aspect of the invention, first main body, first flange, and second flange give the first retainer the cross-sectional shape of an I-beam. In another aspect of the invention, the pin retaining assembly further comprises a retaining pin, wherein the pin receiving slot is configured to receive an end of the retaining pin in a radial direction through the open mouth. In another aspect of the invention, the retaining pin has a cylindrical surface; and wherein an end of the pin receiving slot in the first main body has an arcuate shape complimentary to the cylindrical surface. In another aspect of the invention, a surface of the first main body is flush with a surface of the channel when the first retainer is positioned in the first notch. In another aspect of the invention, the first retainer further includes a removable piece positioned in the open mouth of the pin receiving slot to close the open mouth of the pin receiving slot. In another aspect of the invention, the first retainer further includes a holding pin extending through the first main body and the removable piece to hold the removable piece in the open mouth of the pin receiving slot.

Another aspect of the invention provides a roof support system for a longwall system comprising: an armored face conveyor; a relay bar coupled to the armored face conveyor; an advancing ram having a cylinder end hingedly coupled to the relay bar and a thrust bar linearly movable with respect to the cylinder end; a retaining pin extending through a free end of the thrust bar and having first and second opposite ends; a roof support base; a retention plate rigidly affixed to the roof support base, the retention plate having a channel for receiving the free end of the thrust bar, the retention plate including first and second notches on opposite sides of the channel; and first and second retainers loosely supported in the respective first and second notches, the first and second retainers each including a pin receiving slot for receiving the respective first and second ends of the retaining pin.

In another aspect of the invention, the retention plate includes first and second oppositely-facing surfaces; and the first and second retainers each have at least one flange extending over one of the first and second surfaces of the retention plate. In another aspect of the invention, the retention plate includes first and second oppositely-facing surfaces; the first and second retainers each include a main body, a first flange, and a second flange, wherein the main body, first flange, and second flange give the first retainer the cross-sectional shape of an I-beam; the main bodies of the respective first and second retainers extend through the retention plate in the respective first and second notches; the first flanges of the respective first and second retainers extend over the first surface of the retention plate; and the second flanges of the respective first and second retainers extend over the second surface of the retention plate. In another aspect of the invention, a surface of each of the first and second retainers is flush with a surface of the channel. In another aspect of the invention, the retaining pin has a cylindrical surface; and wherein an end of the pin receiving slot in each of the first and second retainers has an arcuate shape complimentary to the cylindrical surface. In another aspect of the invention, the pin receiving slot in each of the first and second retainers has an open mouth for receiving the retaining pin in a radial direction. In another aspect of the invention, each of the first and second retainers includes a removable piece positioned in the pin receiving slot to close the open mouth and capture the retaining pin. In another aspect of the invention, each of the first and second retainers includes a holding pin extending through the main body and the removable piece to hold the removable piece in the mouth of the pin receiving slot.

Another aspect of the invention provides a method for coupling an advancing ram to a roof support base, the advancing ram including a cylinder end and a thrust bar, the method comprising the steps of: fixing a retention plate to the roof support base, wherein the retention plate includes first and second oppositely-facing surfaces, a channel, a first notch opening into the channel, and a second notch opening into the channel opposite the first notch; inserting a first retainer into the first notch of the retention plate, wherein the first retainer includes a first end flange engaging the first surface of the retention plate and a second end flange engaging the second surface of the retention plate to loosely support the first retainer in the first notch, the first retainer including a pin receiving slot; inserting a second retainer into the second notch of the retention plate, wherein the second retainer includes a first end flange engaging the first surface of the retention plate and a second end flange engaging the second surface of the retention plate to loosely support the second retainer in the second notch, the second retainer including a pin receiving slot; inserting a retaining pin through a free end of the thrust bar; and inserting the retaining pin into the pin receiving slots of the first and second retainers, wherein a first end of the retaining pin is supported by the first retainer, and a second end of the retaining pin is supported by the second retainer.

In another aspect of the invention, step (e) includes radially inserting the retaining pin into the pin receiving slots and simultaneously positioning the thrust bar in the channel. In another aspect of the invention, the pin receiving slots of the first and second retainers include open mouths, wherein step (e) includes radially inserting the retaining pin into the pin receiving slots through the open mouths, the method further comprising the step of securing a removable piece in each of the pin receiving slots to capture the retaining pin in the pin receiving slots.

This Summary is not intended to identify key features or essential features of the claimed subject matter, nor is it intended to be used as an aid in determining the scope of the claimed subject matter.

DETAILED DESCRIPTION

The concepts disclosed herein are not limited in their application to the details of construction and the arrangement of components set forth in the following description or illustrated in the following drawings. That is, the aspects of the invention disclosed herein are illustrative in nature. The concepts illustrated in these aspects of the invention are capable of being practiced or being carried out in various ways. The phraseology and terminology used herein is for the purpose of description and should not be regarded as limiting. Words such as "including," "comprising," and "having" and variations thereof as used herein are meant to encompass the items listed thereafter, equivalents thereof, as well as additional items. Unless specified or limited otherwise, the terms "mounted," "connected," "supported," "captured," and "coupled" and variations thereof are used broadly and encompass both direct and indirect mountings, connections, supports, and couplings.

Figure 1:
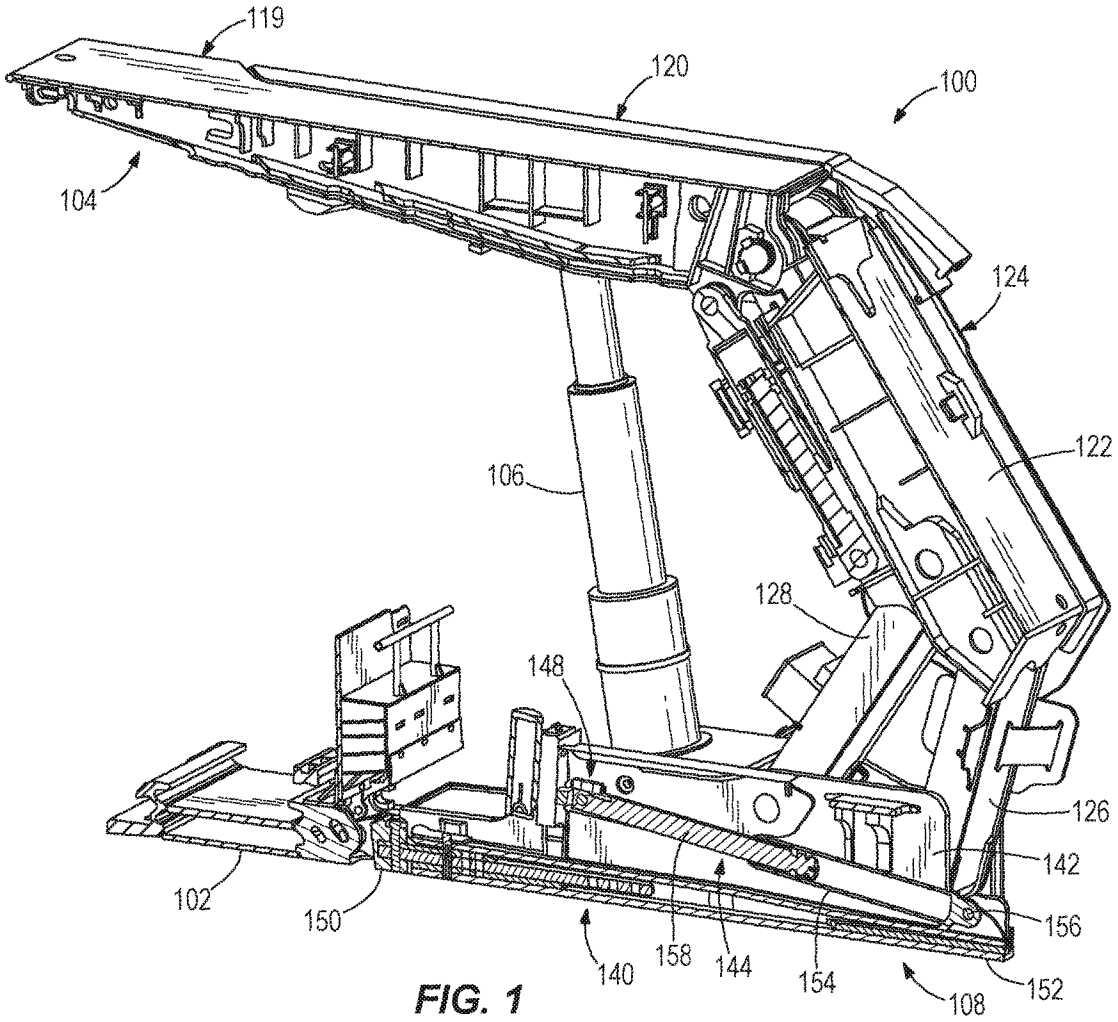
FIG. 1 is a perspective, section view of a hydraulically actuated self-advancing roof support section of a longwall mining system.

FIG. 1 is a perspective, section view of a powered roof support section 100 of a self-advancing longwall mining system. The following description will focus on a single powered roof support section 100, it being understood that a complete self-advancing longwall mining system will include multiple powered roof support sections 100 in a row along the face of a seam being mined. The powered roof support section 100 includes an armored face conveyor section 102, a roof arm assembly 104, a support leg 106 that supports the roof arm assembly 104, and a base assembly 108.

In the complete self-advancing longwall mining system, the multiple armored face conveyor sections 102 extend along the seam being mined. The multiple armored face conveyor sections 102 provide a track for a shearer assembly and an armored face conveyor. The shearer assembly moves along the track provided by the armored face conveyor sections 102 to shear material (e.g., coal) from the seam. The material is caught by the armored face conveyor and conveyed to the ends of the seam where it is conveyed out of the mine.

The armored face conveyor section 102 is in front of the powered roof support section 100. Terms related to direction, such as forward, front, rearward, rear are made with reference to the direction of travel of the self-advancing longwall mining system. The direction of travel (e.g., the forward direction) is into the seam that is being mined by the self-advancing longwall mining system, with the armored face conveyor section 102 leading the way.

The roof arm assembly 104 shields features of the shearer assembly, the armored face conveyor section 102, and other portions and features of the powered roof support section 100 from mining materials falling, collapsing, or caving-in from the mining site ceiling. The roof arm assembly 104 has multiple arms that are hingedly or pivotally coupled to form surfaces such that the collapsed material can slide off the roof arm assembly 104 away from the armored face conveyor during mining operations. The roof arm assembly 104 includes a canopy 119, a canopy flap 120, a rear shield 122, a steering shield 124, a lower link 126, and an upper link 128. The canopy 119 provides a frame to support fallen material. The rear shield 122 is pivotally attached to the canopy 119. The steering shield 124 is coupled to the rear shield 122 and the canopy flap 120 to the canopy 119. The upper link 128 and lower link 126 extend between and interconnect the rear shield 122 and the base assembly 108.

The support leg 106, which is a hydraulic actuator, extends between and interconnects the base assembly 108 and the roof arm assembly 104. The support leg 106 lengthens to push the base assembly 108 into the floor of the mine and the roof arm assembly 104 into the ceiling of the mine. The support leg 106 provides adjustable hydraulic support of the roof arm assembly 104. The support leg 106 is a double telescopic jack that provides a maximum open to closed height ratio for the roof arm assembly 104.

The base assembly 108 includes mechanisms to move the powered roof support section 100 forward as material is removed from the seam. The base assembly 108 includes a relay bar 140, a roof support base 142, an advancing ram 144, and a pin retaining assembly 148 that couples the advancing ram 144 to the roof support base 142.

The relay bar 140 extends along the mine floor between the advancing ram 144 and the armored face conveyor section 102. The front end 150 of the relay bar 140 is coupled to the armored face conveyor section 102. The rear end 152 of the relay bar 140 is positioned near the rear of the roof support base 142 and is coupled to the advancing ram 144.

The roof support base 142 is coupled to the lower link 126 and upper link 128 of the roof arm assembly 104 and provides support for the support leg 106. The advancing ram 144, which is a hydraulic actuator, has a cylinder end 154 connected to the rear end 152 of the relay bar 140 via a relay bar pin 156 and a rod or thrust bar 158 pinned to the front of the roof support base 142 at the pin retaining assembly 148.

As material is removed from a mining wall or site, the self-advancing longwall mining system advances forward through the action of the advancing ram 144. More specifically, as the advancing ram 144 extends, it moves the base assembly 108 (along with the support leg 106 and roof arm assembly 104 which are supported by the base assembly 108) along the relay bar 140 toward the armored face conveyor section 102. As the longwall shearer removes material from the seam in front of the longwall mining system, the advancing ram 144 retracts, which pulls the relay bar 140 forward, which in turn pushes the armored face conveyor section 102 forward into the seam. The advancing ram 144 applies large forces to the roof support base 142. As a result, the connection point between the thrust bar 158 of the advancing ram 144 and the roof support base 142 experiences a high degree of stress.

The pin retaining assembly 148 of the present invention is designed to bear the high stress at the point of connection between the thrust bar 158 and the roof support base 142, and to facilitate initial assembly and replacement of components at the mining site. Known pin retaining assemblies include multiple plates welded together to support a pin that connects the thrust bar 158 to the roof support base 142. The welds create zones of stress concentration that can lead to failure. Replacing and repairing failed pin retaining assemblies with multiple welds is very challenging in the environment of an underground mine, where space is very tight.

Figure 2:
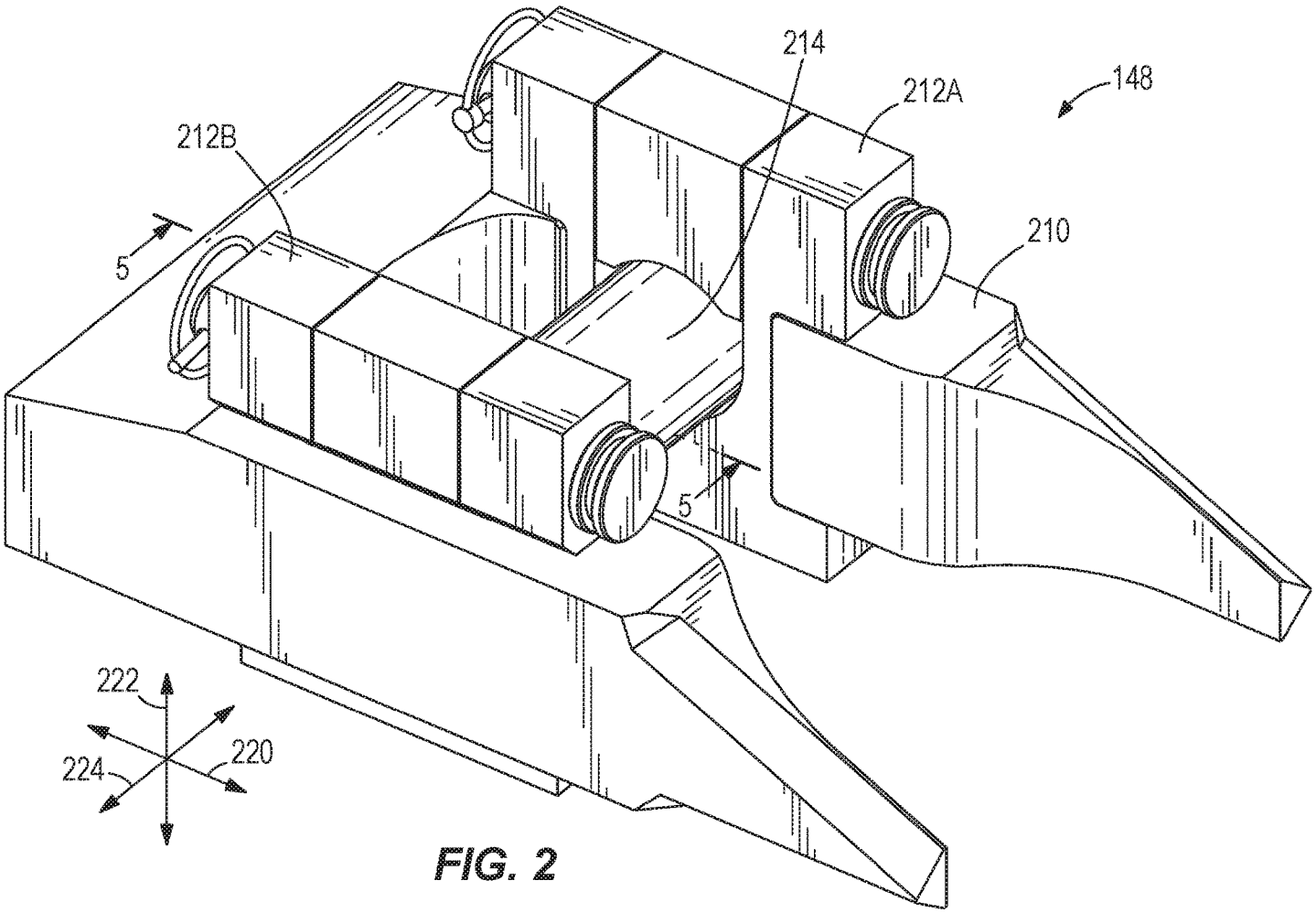
FIG. 2 is a perspective view of a pin retaining assembly for an advancing ram of a powered roof support.

FIG. 2 illustrates a perspective view of the pin retaining assembly 148 of the present invention, which uses fewer welds, includes components less likely to fail due to stress, and includes components that can be more easily replaced in the field compared to known pin retaining assemblies. The pin retaining assembly 148 includes a retention plate 210, a first retainer assembly 212A, and a second retainer assembly 212B. The pin retaining assembly 148 supports and retains a retaining pin 214. The retaining pin 214 is configured to be inserted in a hole in the thrust bar 158 of the advancing ram 144. Force is applied to the retaining pin 214 based on the motion of the advancing ram 144, and that force is transferred through the retaining pin 214 to the pin retaining assembly 148 and ultimately to the roof support base 142 of the powered roof support section 100. The pin retaining assembly 148 is constructed of steel or other hardened metals or materials used in industrial and mining applications.

Reference is made to the illustrated components of the pin retaining assembly 148 using a three dimensional Cartesian coordinate system with an x-axis 220, a y-axis 222, and a z-axis 224. In the illustrated embodiment during ordinary operation, the x-axis 220 is generally aligned with the forward and rearward directions, the y-axis 222 is generally aligned with up and down directions, and the z-axis 224 is generally aligned with lateral directions (i.e., parallel to the seam and the extent of the armored face conveyor). These references are used to assist in describing the features and are not intended to be limiting. The retainer assemblies 212A, 212B are loosely supported by the retention plate 210 and the retainer assemblies 212A, 212B in turn loosely support the retaining pin 214. As used in this disclosure, "loosely support" and its variations means a connection between two components that does not use welding or any other form of permanent affixing, such that one component has at least one degree of freedom of movement with respect to the other component but such that other degrees of freedom are limited or prevented. This will be explained below in more detail with respect to the illustrated embodiment.

Figure 3:
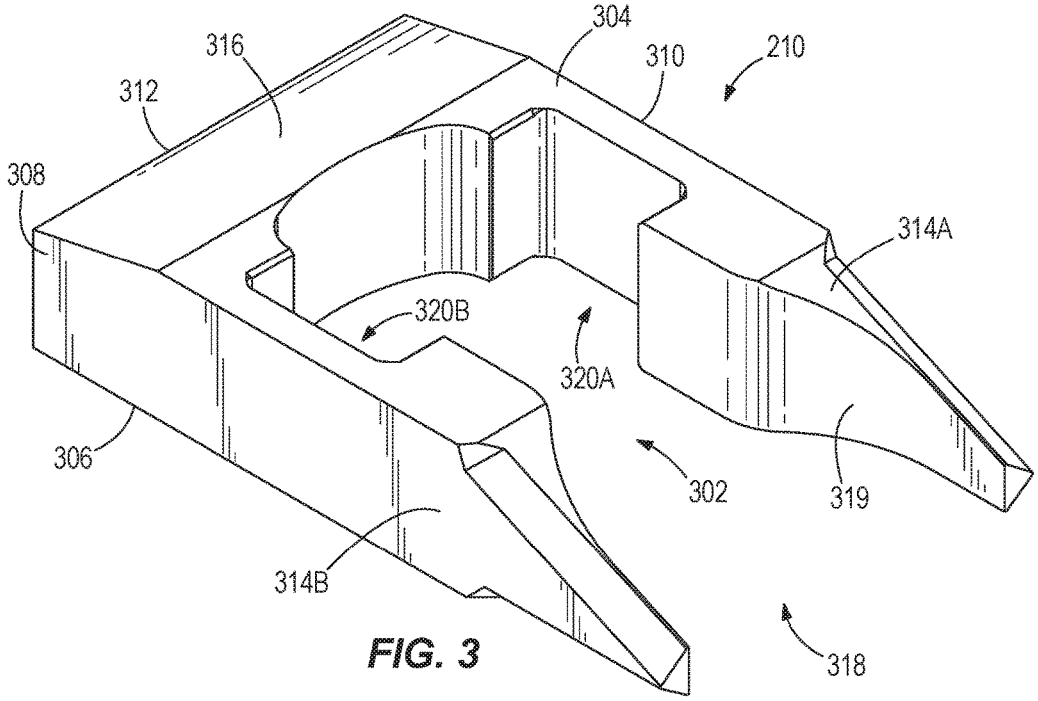
FIG. 3 is a perspective view of a retention plate for the pin retaining assembly.
Figure 5:
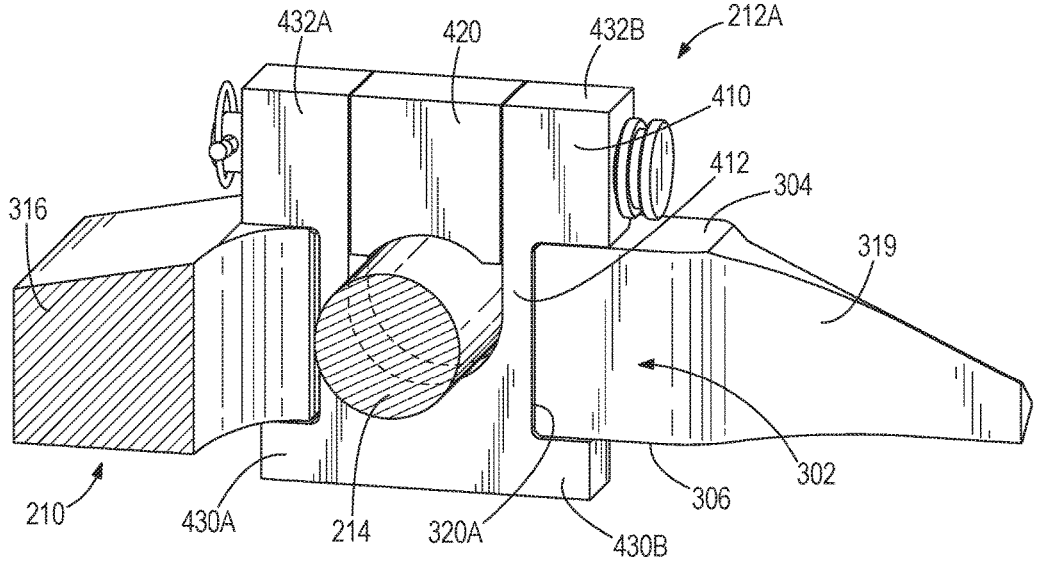
FIG. 5 is a perspective, section view of the pin retaining assembly taken along line 5-5 in FIG. 2.
Figure 4:
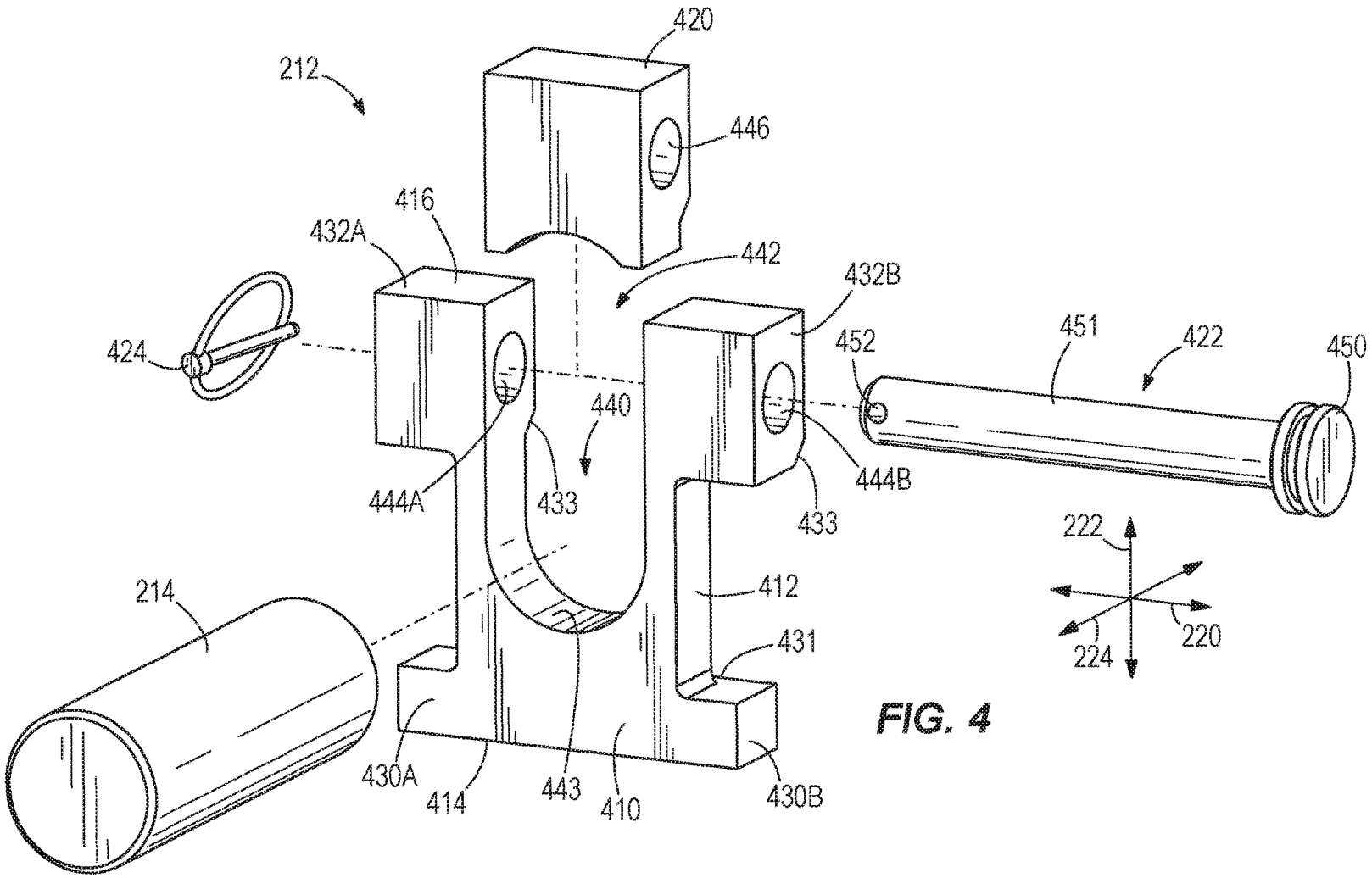
FIG. 4 is a perspective view of a retainer and a retaining pin for the pin retaining assembly.

Although the pin retaining assembly 148 is illustrated as components coupling the roof support base 142 to the advancing ram 144, the pin retaining assembly 148 may also be used in any application where a retaining pin is used to couple two components together. FIGS. 3-5 provide additional details on the features of the pin retaining assembly 148.

FIG. 3 illustrates a perspective view of the retention plate 210 for the pin retaining assembly 148. The retention plate 210 is an integral piece configured to receive the thrust bar 158 that is coupled to the retaining pin 214. The retention plate 210 includes a top surface 304 and a bottom surface 306 that are generally oppositely facing in the y-axis 222 direction. The retention plate 210 also includes a left side surface 308 and a right side surface 310 that are generally oppositely facing in the z-axis 224 direction. A front side surface 312 is generally perpendicular to both the left side surface 308 and the right side surface 310.

The retention plate 210 includes a channel 302, a first extension 314A, a second extension 314B, and a closed end 316. The channel 302 extends from the closed end 316 to an open end 318 and between the first and second extensions 314A, 314B. The first and second extensions 314A, 314B provide side surfaces 319 of the channel 302. The longitudinal axis of the channel 302 defines the x-axis 220 of our reference coordinates. The channel 302 forms an arcuate shape in the closed end 316 of the retention plate 210 to provide clearance for the end of the thrust bar 158.

The first and second extensions 314A, 314B are symmetrical, mirror images of each other about the longitudinal axis of the channel 302. The first and second extensions 314A, 314B have bases at the closed end 316 of the retention plate 210, extend along opposite sides of the channel 302, and have free ends on opposite sides of the open end 318 of the channel. The extensions 314A, 314B taper down from the base ends to the free ends to widen the channel 302 at the open end 318. The outer side surfaces of the extensions 314A, 314B can be welded or otherwise permanently attached to the roof support base 142 of the roof support section 100. The first extension 314A includes a first notch 320A and the second extension 314B includes a second notch 320B. The notches 320A, 320B are formed in the side surfaces 319, open to the channel 302, and face each other across the channel 302 (i.e., are aligned along the x-axis 220).

FIG. 4 illustrates a perspective view of the retainer assembly 212 (the term "retainer assembly 212" refers to both retainer assemblies 212A and 212B, since they are identical to each other) and the retaining pin 214. The retainer assembly 212 includes a retainer 410 that has a main body 412 with a first end 414 and a second end 416, a removable piece 420, a holding pin 422 to couple the removable piece 420 to the retainer 410, and a holding pin retainer 424 to secure the holding pin 422 to the retainer 410. The retainer 410 includes at least one flange on the first end 414 and at least one flange on the second end 416. In the illustrated embodiment, there are two first end flanges 430A, 430B extending in opposite directions parallel to the x-axis 220 and two second end flanges 432A, 432B extending in opposite directions parallel to the x-axis 220. The main body 412, first end flanges 430A, 430B, and second end flanges 432A, 432B together give the retainer assembly 212 the cross-sectional shape of an I-beam.

The flanges 430A, 430B, 432A, 432B include extensions 431, 433. The extensions 431 of the first flanges 430A, 430B are perpendicular in to the main body 412, extending in the z-axis 224 direction. The extensions 431 extend across the entire first end 414 of the main body 412. The extensions 433 of the second flanges 432A, 432B are at an obtuse angle with respect to the main body 412. Each flange 432A, 432B in the second end 416 includes a holding pin hole 444A, 444B extending in the x-axis 220 direction. The holding pin holes 444A, 444B are aligned with each other (i.e., share a common longitudinal axis).

The main body 412 includes a pin receiving slot 440. The longitudinal axis of the pin receiving slot 440 defines the y-axis 222 of our reference coordinates when the retainer assemblies 212A, 212B are inserted in the notches 320A, 320B of the retention plate 210. The longitudinal axis of the retaining pin 214 defines the z-axis 224 of our reference coordinates when the retaining pin 214 is supported by the retainer assemblies 212A, 212B.

The pin receiving slot 440 includes an open mouth 442 and a closed end 443. The open mouth 442 is wider than the diameter of the end of the retaining pin 214 that is received in the pin receiving slot 440. The open mouth 442 receives the retaining pin 214 radially (i.e., in a direction perpendicular to the longitudinal axis of the retaining pin 214) into the pin receiving slots 440. The closed end 443 has an arcuate shape to match a cylinder shape of the retaining pin 214. In another embodiment, the closed end 443 may have a rectangular or angular shape.

The removable piece 420 fits within the open mouth 442 of the pin receiving slot 440. The removable piece 420 is about the same thickness (in the z-axis 224 directions) as the main body 412 so that inward-facing surfaces (i.e., those facing into the channel 302) of the main body 412 and removable piece 420 are flush. The end of the removable piece 420 that faces the closed end 443 of the pin receiving slot 440 may also have an arcuate shape to match the cylinder shape of the retaining pin 214. The removable piece 420 includes a holding pin hole 446 that is aligned with the holding pin holes 444A, 444B in the second end flanges 432A, 432B when the removable piece 420 is inserted into the pin receiving slot 440.

The holding pin 422 includes a head 450 and a shank 451. The head 450 is wider than the holding pin hole 444B. The shank 451 has a circular cross-section and extends from the head 450 to a free end which includes a holding pin retainer hole 452. The shank 451 is sized and shaped to fit within the holding pin holes 444A, 444B, 446 to secure the removable piece 420 in the open mouth 442 of the pin receiving slot 440. The free end of the shank 451 extends beyond the first flange 432A.

The holding pin retainer 424 is illustrated as a linch pin, but in other aspects of the invention can be any suitable retainer pin such as a cotter pin, hitch pin, R-clip, split pin, clevis pin, or bridge pin. The holding pin retainer 424 extends through the holding pin retainer hole 452 to secure the holding pin 422. The holding pin 422 can be easily removed by removing the holding pin retainer 424 and sliding the holding pin 422 out of the holes. This allows easy removal of the removable piece 420 from the retainer assembly 212.

The retaining pin 214 is generally in the shape of a cylinder with a length and a radius (or diameter). Each end is tapered to improve insertion of the retaining pin 214 in a hole in the thrust bar 158. Each end of the retaining pin 214 can be radially inserted in to one of the pin receiving slots 440. The retaining pin 214 couples the advancing ram 144 to the pin retaining assembly 148.

FIG. 5 illustrates a perspective, section view of the retaining pin 214 supported by the retainer assembly 212A. Retainer assembly 212B is identical to retainer assembly 212A and an image of retainer assembly 212B with the retaining pin 214 would be a mirror image of FIG. 5 and will not be separately described. When the retainer assembly 212A is inserted in the notch 320A of the retention plate 210, the inward facing surfaces of the retainer assembly 212A are flush with the side surfaces 319 of the channel 302. As shown, the main body 412 of the retainer 410 extends through a plane formed by the top surface 304 and a plane formed by the bottom surface 306 of the retention plate 210. In this regard, the main body 412 can be said to extend through the retention plate 210.

When installing the thrust bar 158 of the advancing ram 144, the retainers 410 of the first and second retainer assemblies 212A, 212B are first positioned in the respective first and second notches 320A, 320B. This can conveniently be accomplished by moving the retainers 410 into the channel 302 through the open end 318 along the x-axis 220, and then into the notches 320A, 320B along the z-axis 224. The retainers 410 are positioned such that the main bodies 412 are in the notches 320A, 320B (i.e., extend through the retention plate 210 in the notches 320A, 320B), the first end flanges 430A, 430B and extension 431 are in contact with the bottom surface 306, and the second end flanges 432A, 432B and extensions 433 are in contact with the top surface 304.

With the retainers 410 of the first and second retainer assemblies 212A, 212B positioned in the respective first and second notches 320A, 320B, the retaining pin 214 is extended through a hole in an end of the thrust bar 158. Then the end of the thrust bar 158 is positioned in the channel 302 of the retention plate 210 with the opposite ends of the retaining pin 214 received in the pin receiving slots 440. The retaining pin 214 moves radially into the pin receiving slots 440. With the ends of the retaining pin 214 received in the pin receiving slots 440, the removable pieces 420 are installed in the open mouths 442 of the pin receiving slots 440 and the holding pins 422 are inserted through the hole 444A, 444B, 446 of the second end flanges 432A, 432B and the removable pieces 420. Then, the holding pin retainers 424 are inserted in the holding pin retainer holes 452 to prevent the holding pins 422 from being unintentionally removed.

Should a component break or need replacement, the thrust bar 158 can be relatively easily disconnected from the roof support base 142 by reversing the installation steps. First the holding pin retainers 424 are removed from the holding pin retainer holes 452. Then the holding pins 422 are removed from the holding pin holes 444A, 444B, 446. Then the removable pieces 420 are removed from the pin receiving slot 440. Then the thrust bar 158 and retaining pin 214 are lifted out of the channel 302 and pin receiving slots 440 (the retaining pin 214 moving radially out of the pin receiving slots 440). The retainers 410 can be removed from the notches 320A, 320B and into the channel 302 along the z-axis 224 and then out of the channel 302 along the x-axis 220.

Assembly and disassembly are expedited by the retainers 410 being loosely supported in the notches 320A, 320B. The loose support includes the interaction of the main bodies 412 with the notches 320A, 320B to resist movement in the x-axis 220 directions and in the z-axis 224 direction away from the channel 302. The thrust bar 158 in the channel 302 resists movement of the retainers 410 in the z-axis 224 direction toward the channel 302, but in the absence of the thrust bar 158 this degree of freedom is not restricted. The loose support also includes interaction of the flanges 430A, 430B, 432A, 432B and extensions 431, 433 with the top and bottom surfaces 304, 306 of the retention plate 210 to resist movement in the y-axis 222 directions. The loose support requires no welding, additional fasteners or other means for permanently, semi-permanently, or rigidly affixing between the retainers 410 and the retention plate 210, so there are no stress concentrations arising from such affixing means.

The retaining pin 214 is also loosely supported by the pin retaining assembly 148. The retaining pin 214 is restricted from movement along the x-axis 220 by the pin receiving slots 440, along the y-axis 222 by the removable pieces 420 and the closed end 443 of the pin receiving slots 440, and along the z-axis 224 by the retention plate 210, but is permitted to rotate about its own longitudinal axis.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Other examples of modifications of the disclosed concepts are also possible, without departing from the scope of the disclosed concepts.

What is claimed is:

1. A pin retaining assembly for an advancing ram, the pin retaining assembly comprising:
- a retention plate including a first surface, a channel, and a first notch opening into the channel; and
- a first retainer including:
  - a first main body received in the first notch and extending through the first surface of the retention plate;
  - a pin receiving slot in the first main body, the pin receiving slot having an open mouth;
  - a first flange extending from the main body along the first surface of the retention plate such that the first retainer is supported by the retention plate.

2. The pin retaining assembly of claim 1, wherein the retention plate includes a second notch that faces the first notch across the channel, the pin retaining assembly further comprising:
- a second retainer that includes:
  - a second main body received in the second notch and extending through the first surface of the retention plate;
  - a pin receiving slot in the second main body, the pin receiving slot having an open mouth;
  - a first flange extending from second main body along the first surface of the retention plate such that the second retainer is supported by the retention plate.

3. The pin retaining assembly of claim 1, wherein:
- the retention plate includes a second surface facing in a direction opposite the first surface;
- the first main body extends through the second surface of the retention plate; and
- the first retainer includes a second flange extending from the first main body along the second surface of the retention plate.

4. The pin retaining assembly of claim 3, wherein first main body, first flange, and second flange give the first retainer the cross-sectional shape of an I-beam.

5. The pin retaining assembly of claim 1, further comprising a retaining pin, wherein the pin receiving slot is configured to receive an end of the retaining pin in a radial direction through the open mouth.

6. The pin retaining assembly of claim 5, wherein the retaining pin has a cylindrical surface; and wherein an end of the pin receiving slot in the first main body has an arcuate shape complimentary to the cylindrical surface.

7. The pin retaining assembly of claim 1, wherein a surface of the first main body is flush with a surface of the channel when the first retainer is positioned in the first notch.

8. The pin retaining assembly of claim 1, wherein the first retainer further includes a removable piece positioned in the open mouth of the pin receiving slot to close the open mouth of the pin receiving slot.

9. The pin retaining assembly of claim 8, wherein the first retainer further includes a holding pin extending through the first main body and the removable piece to hold the removable piece in the open mouth of the pin receiving slot.

* * * * *